United States Patent [19]

Lewandowski

[11] Patent Number: 4,459,443

[45] Date of Patent: Jul. 10, 1984

[54] TACTILE FEEDBACK SWITCH

[75] Inventor: Raymond Lewandowski, Mount Prospect, Ill.

[73] Assignee: Cherry Electrical Products Corporation, Waukegan, Ill.

[21] Appl. No.: 453,779

[22] Filed: Dec. 27, 1982

[51] Int. Cl.[3] ..... H01H 13/48

[52] U.S. Cl. ..... 200/67 DB; 200/159 A; 200/159 B

[58] Field of Search ..... 200/67 DB, 159 A, 159 B, 200/295

[56] References Cited

U.S. PATENT DOCUMENTS

| | | | |
|---|---|---|---|
| 2,446,141 | 7/1948 | Parsons | 200/295 |
| 3,826,885 | 7/1974 | Allen et al. | 200/159 B |
| 3,967,085 | 6/1976 | Lockhard et al. | 200/159 B X |
| 3,996,429 | 12/1976 | Chu et al. | 200/159 A X |
| 4,022,993 | 5/1977 | Shattuck | 200/159 B |
| 4,129,763 | 12/1978 | Murata | 200/159 A |
| 4,359,614 | 11/1982 | Green et al. | 200/159 A X |

FOREIGN PATENT DOCUMENTS

| | | | |
|---|---|---|---|
| 1079983 | 8/1967 | United Kingdom | 200/67 DB |

*Primary Examiner*—John W. Shepperd
*Assistant Examiner*—Renee S. Kidorf
*Attorney, Agent, or Firm*—Willian, Brinks, Olds, Hofer, Gilson & Lione

[57] ABSTRACT

A tactile feedback switch having a contactor element having a curvilinear portion which temporarily changes from a substantially convex shape to a substantially concave shape upon movement of the contactor element into engagement with an electrical contact. An indentation in the contactor element reduces the force otherwise needed to be applied to the top portion of the contactor element in order to maintain the contactor element in engagement with the electrical contact.

19 Claims, 6 Drawing Figures

TACTILE FEEDBACK SWITCH

BACKGROUND OF THE INVENTION

This invention relates to electrical switches of the type which provide tactile feedback upon actuation. Such switches are generally well known, and typically achieve tactile feedback by utilizing a dome shaped member which inverts when pressure is applied thereto. Electrical switches of this type have been shown to be relatively long-lived, reliable and inexpensive. As such, they have found widespread use in a variety of applications such as keyboards, controls, etc.

In spite of their commercial acceptance, electrical switches of the type described are subject to certain drawbacks, depending on their particular application, and the specific aspects of size, cost and function relating thereto. Accordingly, it is a primary object of this invention to provide an improved electrical switch having tactile feedback. It is another object of this invention to provide such a switch wherein the force needed to maintain it in a closed position is significantly minimized. It is a further object of the invention to provide a multi-position switch incorporating some or all of the foregoing improvements.

SUMMARY OF THE INVENTION

The objects of the invention, along with numerous advantages and features, are achieved in an electrical switch comprising an electrical contact and a contactor element having a curvilinear portion that is normally substantially convex. The curvilinear portion of the contactor element conveys tactile feedback by changing from a substantially convex shape to a substantially concave shape upon movement of the contactor element into engagement with the electrical contact. An indentation, defined in the curvilinear portion of the contactor element, reduces the force otherwise needed to be applied to the curvilinear portion to maintain the contactor element in engagement with the electrical contact.

BRIEF DESCRIPTION OF THE DRAWINGS

An exemplary embodiment of the invention summarized above is illustrated in the accompanying drawings wherein.

DETAILED DESCRIPTION OF THE PREFERRED EMBODIMENT

Figure 1:
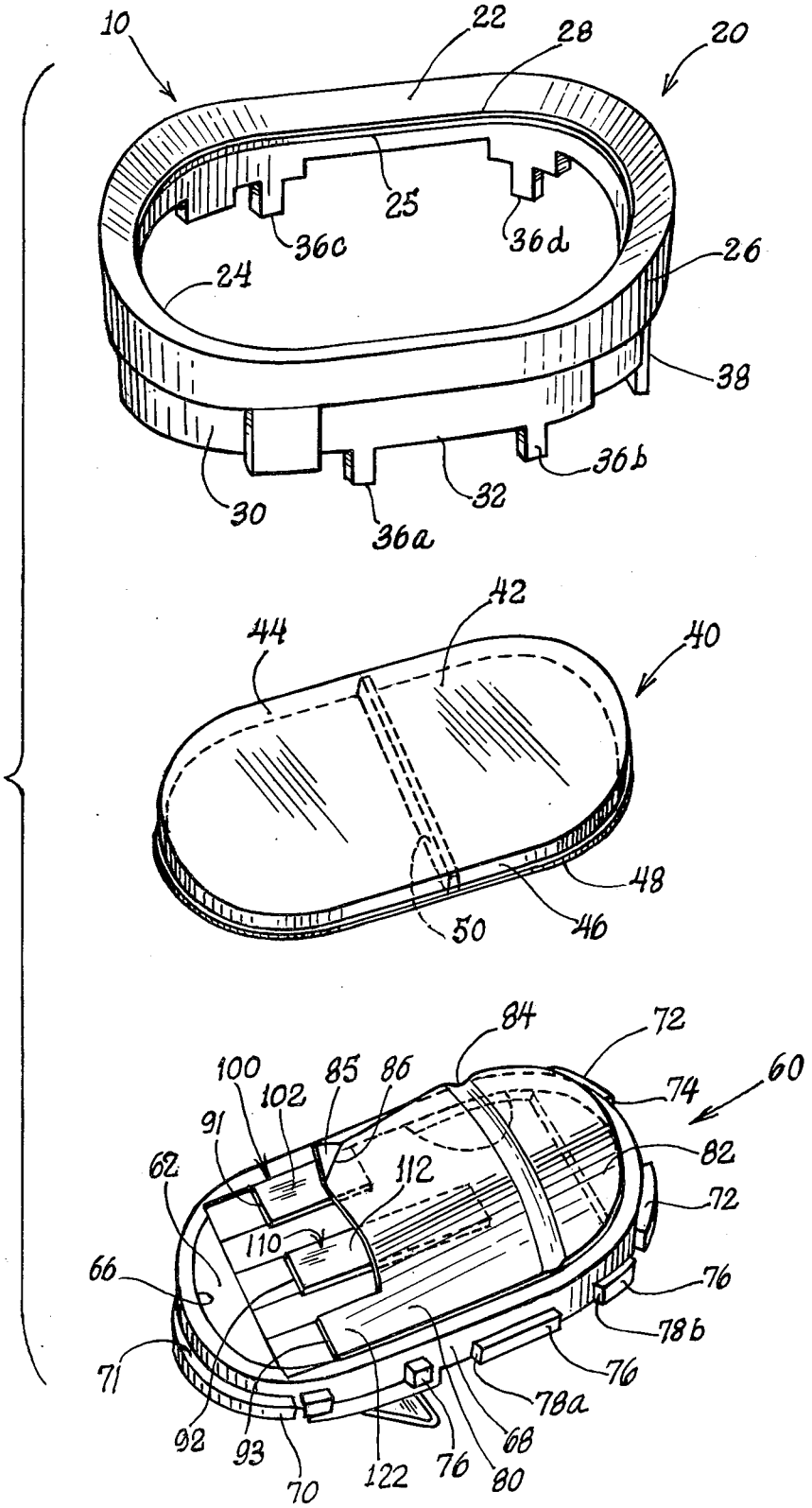
FIG. 1 is an exploded, schematic view, taken in perspective, of the components of a switch incorporating the invention.
Figure 2:
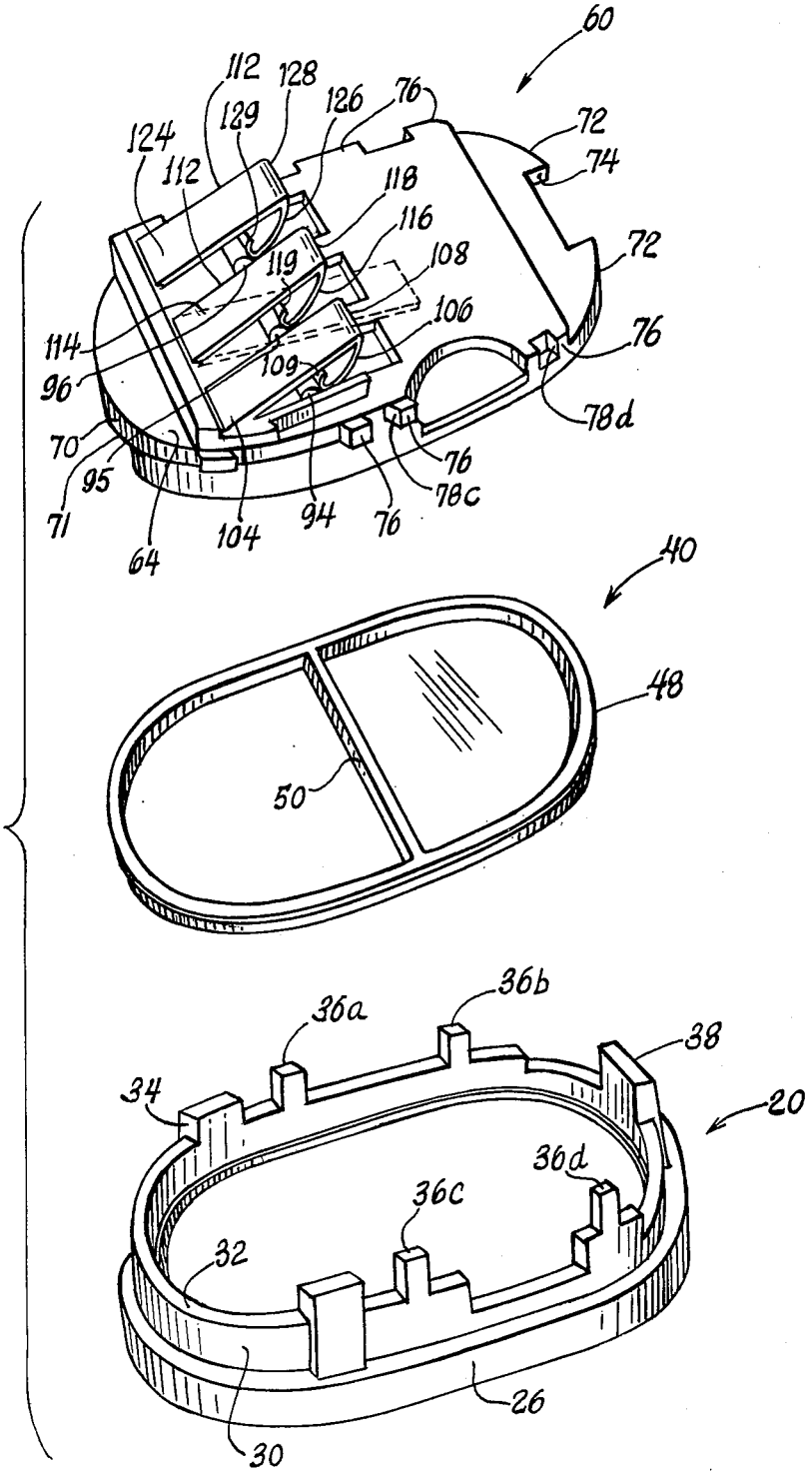
FIG. 2 is an exploded, schematic view, taken in perspective, of the underside of the components of the switch shown in FIG. 1.

Referring now to the Figures, and in particular FIGS. 1 and 2, there is shown a preferred embodiment of a tactile feedback switch identified by the reference numeral 10. Switch 10 is shown to be comprised of three main components: a frame member 20, an actuator 40 and a base 60.

Frame member 20, which can be made from any suitable material such as a plastic sold by the General Electric Company under the trademark NORYL, preferably includes a subframe 30 defining a central opening 28. Subframe 30 may support an escutcheon portion 22 which slopes downwardly and inwardly toward opening 28. Escutcheon portion 22 includes an inner side wall 24 and an outer side wall 26. Disposed about the inner side wall 24 is a flange 25 extending toward opening 28. In this preferred embodiment frame member 20 further includes a plurality of mounting tabs **36*a*–36*d* and a mounting key 38 extending downwardly from the bottom edge 32 of subframe 30**.

Actuator 40 preferably comprises a pressure surface 42, an inner side wall 44 and an outer side wall 46. Disposed about the perimeter of actuator 40, extending outwardly from outer side wall 46, is a peripheral shelf 48. Actuator 40 is preferably dimensioned so that it fits in opening 28 defined by subframe 30 of frame member 20 with the upper surface of shelf 48 in abutting relationship with the lower surface of flange 25. This abutting relationship tends to limit the amount of dust or other impurities that may otherwise find their way into the interior of switch 10. An actuator rib 50 preferably extends transversely across the underside of pressure surface 42. Actuator 40 is preferably made from any suitable ABS material such as CYCOLAC manufactured by Borg-Warner.

Base 60, which may be made from the same material as frame member 20, typically comprises a first or top surface 62, and a second or bottom surface 64. Though the top surface 62 and the bottom surface 64 of base 60 are referred to as surfaces, it should be understood that, as the term "surface" is used herein, it is not limited to an area which is completely flat, but may comprise an area which actually has protuberances and depressions for facilitating manufacture, assembly, etc. Moreover, the terms top and bottom, as used herein, are intended to define the relative positions of certain mechanical components of switch 10, and therefore the use of those terms should not be construed to limit the orientation of switch 10 in actual use.

In this embodiment, base 60 is characterized by an inner side wall 66, an outer side wall 68 and a subframe support 70 extending at least partially about the perimeter of base 60 defined by outer side wall 68. Subframe support 70 includes a subframe support surface 71 to which the bottom edge 32 of subframe 30 of frame member 20 is fastened. Such fastening may be accomplished by any suitable means such as adhesives, solvent welding, etc. When so fastened, however, actuator 40 is sandwiched between frame member 20 and base 60 with pressure surface 42 preferably below the uppermost portion of frame member 20 and above the lowermost portion of base 60, and with the upper surface of peripheral shelf 48 in abutting relationship with the lower surface of flange 25 as previously described.

Base 60 also preferably includes a plurality of subframe tabs 76 defining corresponding subframe notches **78*a*–78*d*, and a pair of alignment tabs 72 defining an alignment notch 74. Subframe tabs 76, and hence subframe notches 78*a*–78*d* are preferably dimensioned so that the latter accommodate respective mounting tabs 36*a*–36*d*. This enables frame assembly 10 to be accurately positioned on, and firmly mounted to, base 60. Similarly, alignment tabs 72**, and hence alignment notch 74, is preferably dimensioned to accommodate mounting key 38 of frame member 10. Since base 60 has alignment tabs 72 on only one end thereof, frame member 10 can only be mounted on base 60 in the manner shown in FIGS. 1 and 2; i.e., it cannot be mounted backwards.

Disposed on first surface 62 of base 60 is a first electrical contact 100 and a second electrical contact 110. First and second electrical contacts 100,110 include, respectively, first and second strips 102,112 of electrically conductive material. First and second strips 102,112 preferably extend in parallel along first surface 62 of base 60 as shown in FIG. 1, with second strip 112 being somewhat longer than first strip 102. For reasons that will become apparent hereinafter, it may be desirable for first surface 62 to include a protuberance (not shown) to raise first strip 102 slightly above second strip 112.

Figure 5:
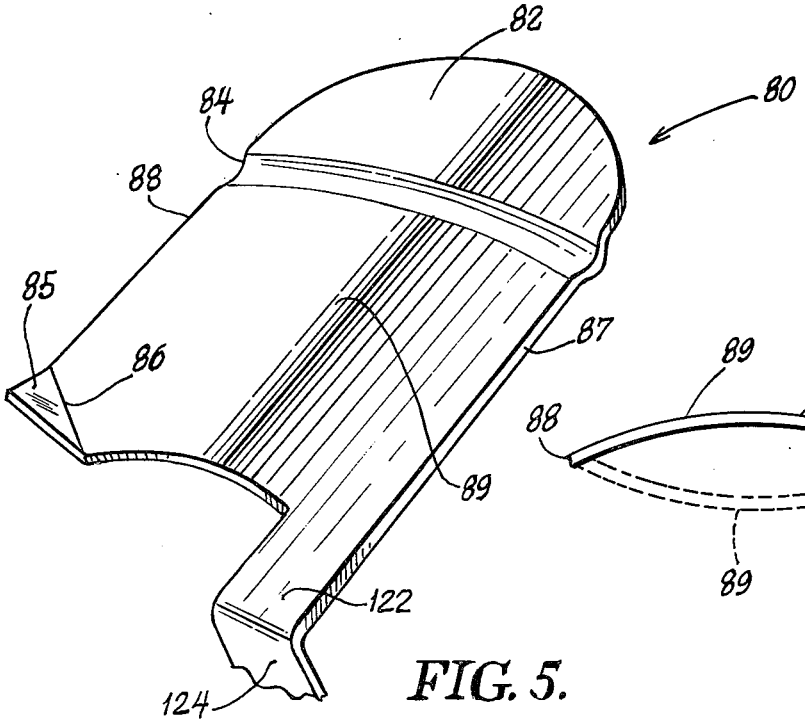
FIG. 5 is an enlarged perspective view of a portion of the contactor element used in the switch of FIG. 1.
Figure 6:
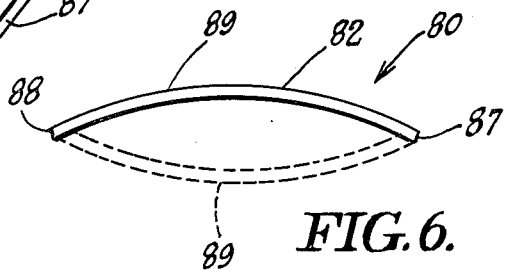
FIG. 6 is an edge view of the portion of the contactor element shown in FIG. 5.

Switch 10 further includes a contactor element 80, a portion thereof being shown in FIGS. 5 and 6. Contactor element 80 includes a top portion 82 which may be made from electrically conductive material such as gold plated stainless steel, and has a preferred thickness of about 0.0037 inches. Top portion 82 preferably defines a pair of parallel edges 87,88 and a curvilinear portion 89. Curvilinear portion 89 is normally substantially convex, it being defined as such in this embodiment when the imaginary plane passing through edges 87,88 is below at least enough of curvilinear portion 89 so that the application of an appropriate force to top portion 82 will result in a snapping action capable of conveying tactile feedback. As shown by the dotted lines in FIG. 6, when such an appropriate force is applied to top portion 82, at least a portion of curvilinear portion 89 is converted, at least temporarily, to at least a partially concave shape. Of course, when the force applied to top portion 82 is removed, curvilinear portion 89 returns to its original, substantially convex shape.

Curvilinear portion 89 of top portion 82 further includes means defining an indentation 84 which extends at least partially across top portion 82 between edges 87,88. Indentation 84 reduces the force that would otherwise be needed to be applied to top portion 82 to maintain the curvilinear portion 89 in the substantially concave shape represented schematically by the dotted lines in FIG. 6. In view of the foregoing, it should be clear that in this embodiment the force which must be applied to top surface 82 of contactor 80 to provide the snapping action which conveys tactile feedback, i.e., the force which changes curvilinear portion 89 from a substantially convex shape to a substantially concave shape, is greater than the force needed to be applied to top surface 82 to maintain the curvilinear portion 89 in its substantially concave shape.

In one corner of contactor 80 there is formed a raised tab 85 defining a crease or a bend 86. The purpose of bend 86 is to define a line of increased pressure, thereby ensuring adequate, reliable engagement with the underlying first electrical contact 100 upon actuation of switch 10. At an adjacent corner of contactor 80 there is a third strip 122 of electrically conductive material which extends substantially in parallel with first and second strips 102,112 of first and second electrical contacts 100,110, respectively.

Base 60 preferably defines three slots 91,92,93 which provide communication between first surface 62 and second surface 64. Slots 91, 92 and 93 are of such dimensions as to accommmodate, respectively, first, second and third strips 102, 112 and 122. Thus, as shown in FIGS. 1 and 2, strips 102, 112 and 122 are adapted to pass through slots 91, 92 and 93 respectively, emerging at second surface 64 of base 60.

As shown in FIG. 2, strips 102, 112 and 122 include, respectively, first legs 104, 114 and 124, second legs 106, 116 and 126, and intermediate acute angled portions 108, 118 and 128 connecting the corresponding first and second legs of strips 102, 112 and 122. The second legs 106, 116 and 126 terminate in turned over portions 109, 119 and 129, respectively, which may rest against respective abutments 94,95,96 formed in second surface 64 of base 60. Moreover, second legs 106, 116 and 126 are preferably bowed slightly outward between respective intermediate acute angled portions 108, 118 and 128, and respective turned over portions 109, 119 and 129. Indeed, it is preferred that, after installation on base 60, legs 106, 116 and 126 of strips 102, 112 and 116 are overstressed, i.e., bowed beyond their elastic limit (the point beyond which the legs will not spring back to their original position), against abutments 94, 95 and 96. When then set against abutments 94, 95 and 96 in the manner described, substantially uniform forces result. This construction thus gives each of strips 102, 112 and 122 a substantially uniform resilience or springiness when urged against an underlying substrate such as a printed circuit board (not shown). Thus, when switch 10 is mounted to an underlying printed circuit board or the like with a small pressure urging the intermediate acute angled portions 108, 118 and 128 into engagement with corresponding electrical elements on the printed circuit board, a faithful, reliable electrical connection is made and maintained.

In this preferred embodiment, switch 10 is adapted to operate as a two-position switch. Thus, when contactor element 80 is urged downwardly by actuator 40, it will preferably engage first electrical contact 100 before it engages second electrical contact 110. This may be accomplished in any suitable manner such as supporting first electrical contact on a protuberance (not shown) on first surface 62 of base 60 so it is raised above second electrical contact 110, canting contactor element 80 so that edge 88 is mounted somewhat higher than edge 87, and aligning second electrical contact 110 under the line of maximum convexity defined by curvilinear portion 89.

In a preferred embodiment, switch 10 is adapted to be used in cameras of the type having electrically operated shutters, though the invention claimed herein is not so limited. In such an environment, electrical contact 100 may be adapted to engage, via intermediate acute angled portion 108, an electrical element on a printed circuit board which is connected to a battery supply (not shown). Thus, when bend 86 of contactor element 80 engages first electrical contact 100, the camera shutter is placed in a standby powerized mode. When contactor element 80 subsequently engages second electrical contact 110, electrical means (not shown) operate the camera shutter. Removing some pressure on actuator 40 permits contactor element 80 to move out of engagement with second electrical contact 110, while remaining in the standby powerized mode wherein bend 86 of contactor element 80 is still in engagement with first electrical contact 100. Subsequently, additional pressure may be applied to actuator 40 to again bring contactor element 80 into engagement with second electrical contact 110. It will therefore be appreciated that this two-position feature of switch 10 allows "rapid fire" shutter action because, as long as bend 86 of contactor element 80 remains in engagement with first electrical contact 100, the shutter stays in the standby powerized mode.

It should also be appreciated that switch 10 can be mounted in a camera so that the direction of force applied to contactor element 80 is substantially perpendicular to the direction of the force of gravity, i.e., the direction of force applied to contactor element 80 is horizontal. This reduces the likelihood that the operation of the shutter by activation of switch 10 will cause the camera to inadvertently move vertically downward, thereby producing a blurred photograph.

Figure 3:
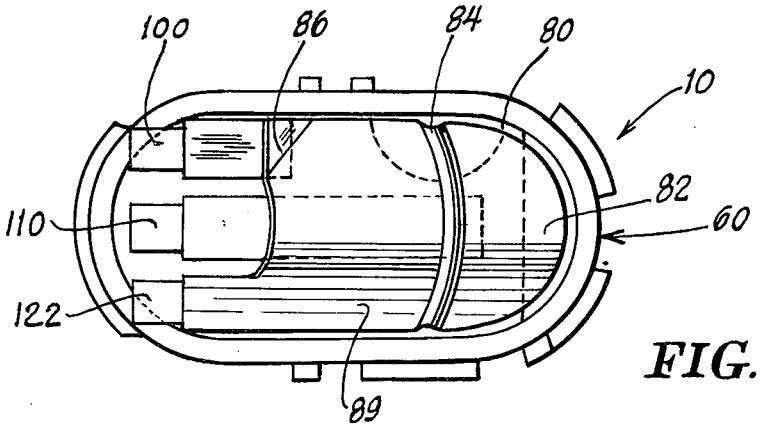
FIG. 3 is a plan view of a portion of the switch shown in FIG. 1 in an open condition.
Figure 4:
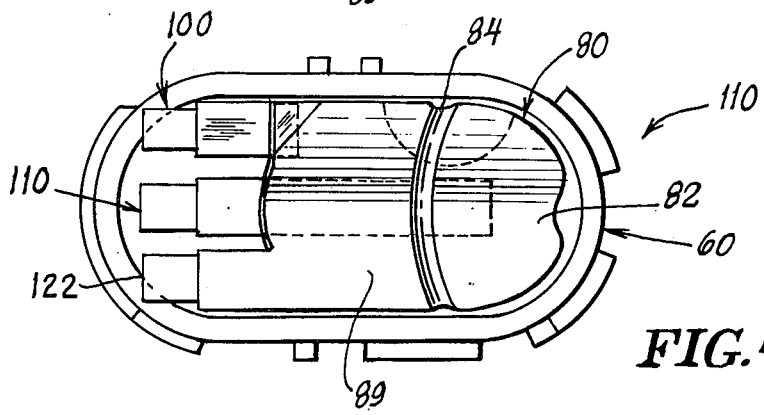
FIG. 4 is a plan view of the switch of FIG. 3 in a closed condition.

The operation of switch 10 can be better appreciated by reference to FIGS. 3 and 4. In FIG. 3 top portion 82 of contactor element 80 is shown with curvilinear portion 89 in its normally convex shape. In this shape contactor element 80 does not engage either first electrical contact 100 or second electrical contact 110. When a force is applied to contactor element 80 by the movement of actuator rib 50 of actuator 40 (FIGS. 1 and 2) against top portion 82 of contactor element 80, bend 86 engages first electrical contact 100. At this instant, however, curvilinear portion 89 of top portion 82 preferably maintains its original convex shape.

Upon the application of additional force to contactor element 80, however, curvilinear portion 89 assumes a substantially concave shape as shown in FIG. 3, thereby providing tactile feedback. In that shape curvilinear portion 89 engages second electrical contact 110. Due to indentation 84, however, the force needed to maintain curvilinear portion 89 in its substantially concave shape is less than it would otherwise be. Of course, when the force applied to contactor element 80 is removed, curvilinear portion 89 returns to its original convex shape as shown in FIG. 3.

What has been described is a novel tactile feedback switch. The switch has preferred application as a two position switch in cameras employing electrically operated shutters. Other applications will be apparent to those skilled in the art, and therefore the claims are not intended to be so limited. Moreover, it should be clear that numerous changes, modifications and variations in the embodiments herein described which do not part from the true scope of the invention will also become apparent to those skilled in the art. Accordingly, all such changes, modifications and variations are intended to be covered by the appended claims.

I claim:

1. An electrical switch comprising:

an electrical contact; and a contactor element, normally displaced from said electrical contact, including a curvilinear portion normally having a substantially convex shape;

said curvilinear portion for temporarily flexing to at least a partially concave shape to provide tactile feedback and to conductively engage said electrical contact in response to an actuation force;

said curvilinear portion having an elongated transverse indentation for causing the curvilinear portion to flex into conductive engagement with said electrical contact in response to a particular actuation force less than the actuation force required to flex the curvilinear portion in the absence of said indentation.

2. The electrical switch defined in claim 1 wherein the portion of said contactor element moved into engagement with said electrical contact includes at least a portion of said indentation.

3. An electrical switch comprising:

a first electrical contact;

a second electrical contact; and a contactor element normally displaced a first distance from said first electrical contact, and a second distance from said second electrical contact;

said contactor element for initially conductively engaging said first electrical contact in response to a first actuation force applied to the contactor element and subsequently conductively engaging said second electrical contact upon application of a second greater actuation force to said contactor element;

said contactor element further including a curvilinear portion, normally having a substantially convex shape for temporarily flexing to at least a partially concave shape to provide tactile feedback and to conductively engage said second electrical contact;

said curvilinear portion having an elongated transverse indentation for causing the curvilinear portion to flex into conductive engagement with said second electrical contact in response to a second actuation force which is less than the actuation force required to flex the curvilinear portion in the absence of said indentation.

4. The electrical switch defined in claim 3 wherein the portion of said contactor element moved into engagement with said second electrical contact includes at least a portion of said indentation.

5. The electrical switch defined in claim 3 further including mounting means for orienting said switch so that the direction of the force applied to said contactor element for urging the latter into engagement with said first and second electrical contacts is substantially perpendicular to the direction of the gravitational force.

6. The electrical switch defined in claim 3 further including:

a base having first alignment means; and a frame member having second alignment means, said first and second alignment means being adapted for mating engagement only when said frame member is properly oriented with said base.

7. The electrical switch defined in claim 3 wherein one corner of said contactor element has a bend forming a raised tab, said bend for conductively contacting said first electrical contact when said contactor element is moved into engagement therewith.

8. The electrical switch of claim 3 further including a base for supporting said contactor element over said first and second electrical contacts, said base having a top surface adjacent to said contactor element, and a bottom surface opposite said top surface;

said first and second electrical contacts each including an electrically conducting terminal strip having a top terminal leg, a first bottom terminal leg bent at an acute angle with respect to said top terminal leg, a second bottom terminal leg bent at an acute angle with respect to said first bottom terminal leg and a free end portion of said second bottom terminal leg; and means for mounting each of said terminal strips so that said top terminal leg lies along said top surface of the base and said bottom terminal legs are disposed adjacent to said bottom surface of the base with said free end portion pressing against the bottom surface of the base to outwardly bias the first bottom terminal leg.

9. The electrical switch defined in claim 3 further including:

a base supporting said contactor element, said first electrical contact and said second electrical contact; and an actuator, adapted to apply an appropriate force to said curvilinear portion of said contactor element for urging said contactor element into engagement with said first and second electrical contacts.

10. The electrical switch defined in claim 9 wherein said actuator comprises a pressure surface and an underlying rib member adapted to engage said curvilinear portion of said contactor element and urge said contactor element toward said first and second electrical contacts upon application of an appropriate force to said pressure surface.

11. The electrical switch defined in claim 9 further including:

a frame member having peripheral flange means; and peripheral shelf means, associated with said actuator, adapted to cooperate with said flange means of said frame member.

12. The electrical switch defined in claim 11 further including:

means for mounting said frame member to said base so that at least some portion of said actuator is disposed between the portions of said base and said frame member most displaced from each other.

13. The electrical switch defined in claim 3 further including a base supporting said first electrical contact, said second electrical contact, and said contactor, wherein:

said first electrical contact comprises a first strip of electrically conductive material extending along a first surface of said base;

said second electrical contact comprises a second strip of electrically conductive material, substantially longer than said first strip, extending along said first surface of said base; and said contactor element comprises a third strip of electrically conductive material and an electrically conductive top portion extending therefrom, at least a portion of said top portion being biased in a position displaced from said first surface of said base.

14. The electrical switch defined in claim 13 wherein said first, second and third strips are substantially parallel.

15. The electrical switch defined in claim 13 wherein said base defines first, second and third slots communicating between said first surface of said base and a second surface thereof, and wherein said first, second and third strips pass, respectively, through said first, second and third slots.

16. The electrical switch defined in claim 15 wherein each of said first, second and third strips has a first leg portion extending away from said second surface of said base, a second leg portion extending toward said second surface of said base and an intermediate portion forming an acute angle with respective ones of said first and second leg portions, each of said intermediate portions being adapted to form a spring contact with a corresponding circuit element.

17. The electrical switch defined in claim 16 wherein each of said second leg portions has a free end portion for pressing against said base in a stressed, bowed relation to outwardly bias said first leg portion and said intermediate portion.

18. The electrical switch defined in claim 16 wherein at least one of said second leg portions is bowed by overstressing the second leg portion against the base.

19. An electrical switch, comprising;

a first electrical contact;

a second electrical contact; and contactor means normally displaced a first distance from said first electrical contact and a second greater distance from said second electrical contact;

a base for supporting said contactor means over said first and second electrical contacts, said base having a top surface adjacent to said contactor means, and a bottom surface opposite said top surface;

said contactor means having a curvilinear portion for partially flexing to initially conductively engage said first electrical contact in response to a first actuation force and for subsequently snapping downwardly to conductively engage said second electrical contact upon application of a second greater actuation force, the curvilinear portion including an elongated indentation for minimizing the second actuation force; and a termination means for each of said electrical contacts and said contactor means, each termination means including a first electrically conducting leg portion mounted on the bottom surface of said base and extending away from the base, a second electrically conducting leg portion conductively connected to the first leg portion and positioned at an acute angle with respect to the first leg portion, and a free end portion of said second leg portion for engaging the base in a stressed relation to outwardly bias the first leg portion.

* * * * *